US005916390A

United States Patent [19]

Rückert et al.

[11] Patent Number: 5,916,390

[45] Date of Patent: Jun. 29, 1999

[54] CYLINDER LINER COMPRISING A SUPEREUTECTIC ALUMINUM/SILICON ALLOY FOR SEALING INTO A CRANKCASE OF A RECIPROCATING PISTON ENGINE AND METHOD OF PRODUCING SUCH A CYLINDER LINER

[75] Inventors: Franz Rückert, Ostfildern; Peter Stocker, Sulzbach/Murr; Roland Biedermann, Stuttgart, all of Germany

[73] Assignee: Mercedes-Benz AG, Stuttgart, Germany

[21] Appl. No.: 08/967,032

[22] Filed: Nov. 10, 1997

Related U.S. Application Data

[62] Division of application No. 08/544,978, Oct. 30, 1995, abandoned.

[51] Int. Cl.[6] ..... C22C 1/00

[52] U.S. Cl. ..... 148/689; 148/688; 148/691; 148/437; 148/438; 148/439; 148/440

[58] Field of Search ..... 148/689, 688, 148/691, 437, 438, 439, 440

[56] References Cited

U.S. PATENT DOCUMENTS

| | | | |
|---|---|---|---|
| 4,055,417 | 10/1977 | Komiyama et al. | 75/142 |
| 4,934,351 | 6/1990 | Shepley | 123/193 |
| 4,938,810 | 7/1990 | Kiyota et al. | 148/437 |
| 4,959,276 | 9/1990 | Hagiwara et al. | 428/614 |
| 5,057,274 | 10/1991 | Futamura et al. | 420/534 |
| 5,253,625 | 10/1993 | Donahue et al. | 123/193.4 |

FOREIGN PATENT DOCUMENTS

| | | |
|---|---|---|
| 0 508 426 | 10/1992 | European Pat. Off. . |
| 72 42 072 | 8/1973 | France . |
| 2 343 895 | 10/1977 | France . |
| 24 08 276 | 8/1975 | Germany . |
| 1109084 | 4/1968 | United Kingdom . |

*Primary Examiner*—Patrick Ryan
*Assistant Examiner*—M. Alexandra Elve
*Attorney, Agent, or Firm*—Evenson, McKeown Edwards & Lenahan P.L.L.C.

[57] ABSTRACT

The invention relates to a cylinder liner sealed into a reciprocating piston engine comprising a supereutectic aluminum/silicon alloy which is free of mixed-in particles of hard material and which is composed in such a way that fine silicon primary crystals and intermetallic particles automatically form from the melt as hard particles. A blank is allowed to grow from finely sprayed melt droplets by spray compaction, with a fine distribution of hard particles being produced by setting the spray for small melt droplets. The blank can then be formed by cold extrusion to create a shape approximating the cylinder lining. After premachining, the surface is fine machined, honed in at least one stage and then the hard particles lying at the surface are mechanically exposed, is forming plateau areas of hard particles which project above the remaining surface of the base microstructure of the alloy. The mechanical exposure of the primary crystals or particles is carried out by a honing process using felt strips which are cylindrically shaped on the outside and a slurry of SiC particles in honing oil. The fine-grained, hard particles formed from the melt and also the mechanical exposure of the hard particles on the surface of the cylinder results not only in high wear resistance and high contact area of the surface, but also in gentle treatment of the piston and its rings.

8 Claims, 3 Drawing Sheets

CYLINDER LINER COMPRISING A SUPEREUTECTIC ALUMINUM/SILICON ALLOY FOR SEALING INTO A CRANKCASE OF A RECIPROCATING PISTON ENGINE AND METHOD OF PRODUCING SUCH A CYLINDER LINER

This application is a divisional of application Ser. No. 08/544,978, filed Oct. 30, 1995.

BACKGROUND AND SUMMARY OF THE INVENTION

The invention discloses a cylinder liner which is sealed into a reciprocating piston engine, comprising a supereutectic aluminum/silicon alloy and a method of producing such a cylinder liner, in which the surface of the cylinder is first roughly machined, then fine machined by boring or turning, and subsequently honed in at least one stage, in which the surface particles which are harder than the base microstructure of the alloy, such as silicon crystals and/or intermetallic phases, are then exposed in level areas projecting above the remaining surface of the base microstructure of the alloy.

Hagiwara, et al., EP 367,229 discloses a cylinder liner which is made of metal powder, such as aluminum oxide, with from 0.5 to 3% graphite particles mixed-in, which have a particle diameter of at most 10 $\mu$m or less (measured in a plane perpendicular to the cylinder axis) and from 3 to 5% hard material particles without sharp edges, which have a particle diameter of at most 30 $\mu$m and on an average 10 $\mu$m or less. The metal powder is produced first, without mixing-in the nonmetallic particles, by air atomization of a supereutectic aluminum/silicon alloy having the following composition, with the remainder being aluminum (figures are in % weight based on the total metal content of the alloy, i.e. without the particles of hard material and graphite):

Silicon from 16 to 18 g,

Iron from 4 to 6%,

Copper from 2 to 4%,

Magnesium from 0.5 to 2% and

Manganese from 0.1 to 0.8%

The metal powder is mixed with the nonmetallic particles and then pressed at about 2000 bar to make a preferably tubular body. This powder metallurgically produced blank is inserted into a soft aluminum tube of corresponding shape to make a double layer tube, which is jointly sintered and shaped in an extrusion processing preferably at elevated temperatures, to give a tubular blank from which the individual cylinder liners can be produced.

The embedded particles of hard material are intended to give the cylinder liner good wear resistance, while the graphite particles serve as dry lubricants. However, to avoid oxidation of the graphite particles, the hot extrusion should take place in the absence of oxygen. There is also the danger of the graphite reacting with the silicon at high processing temperatures and forming hard SiC on the surface, which interferes with the dry-lubricating properties of the embedded graphite particles. Furthermore, local surface fluctuations in the concentration of particles of hard material and/or graphite can never be entirely eliminated.

Other disadvantages of Hagiwara, et al. '229, are due to the fact that the embedded particles of hard material, despite their rounded edges, still have strong abrasive action, thereby causing the hotpressing die to wear out relatively quickly. In any case, only a partial rounding of the particle edges formed by crushing can be achieved with justifiable effort. High tool wear, and thus high tool costs, is also associated with the subsequent machining of the surface of the cylinder liner. After machining, the hard material particles exposed on the surface, have sharp edges and cause relatively high wear of the piston and the piston rings, therefore, these have to be made of wear-resistant material or be provided with appropriate wear resistant coating.

Basically, the Hagiwara, et al. '229 cylinder liner is not only relatively expensive because the starting materials require several separate components, but also because of the high tool costs associated with the process. Additionally, because these known cylinder liners are produced from a heterogeneous powder mixture, the danger of inhomogeneities exists, which may result in impaired function, and thus in rejects, requiring careful quality control. In addition, for use in an engine, complicated piston construction is required, which makes the entire reciprocating piston engine more expensive.

Kiyota, et al., U.S. Pat. No. 4,938,810, likewise discloses a powder-metallurgically produced cylinder liner. In Kiyota, et al. '810, the silicon content of the examples provided are in the range of from 10 to 30%, which extends into the subeutectic region, and preferably from 17.2 to 23.6%. At least one of the metals nickel, iron, or manganese, should be present in the alloy to the extent of at least 5%, or in the case of iron, to the extent of at least 3%. To follow is an example in Kiyota, et al. '810 of an alloy composition in % by weight, where the remainder is aluminum, and the content of zinc and manganese are not specified, and are therefore assumed to be present in trace quantities only:

Silicon: 22.8%,

Copper: 3.1%,

Magnesium: 1.3%,

Iron: 0.5% and

Nickel: 8.0%.

It should be noted that the nickel content in the alloy example given above is very high- Kiyota, et al. '810 further discloses that a blank for a cylinder liner is hot-extruded from the powder mixture.

Perrot, et al., U.S. Pat. No. 4,155,756, also concerns a powder-metallurgically produced cylinder liner. In one example, the composition is as follows, with the remainder being aluminum:

Silicon: 25%,

Copper: 4.3%,

Magnesium: 0.65% and

Iron: 0.8%.

An object of the present invention is to improve cylinder liners by increasing wear resistance, thereby reducing the danger of wear on the piston, and decreasing the amount of lubricating oil necessary. The main interest in reducing the amount of lubricating oil necessary does not so much concern the lubricating oil itself, but rather its combustion residues, essentially hydrocarbons, which pollute the exhaust gas emitted from internal combustion engines.

This object is achieved according to the present invention by a cylinder liner which is sealed into a reciprocating piston engine, comprising a supereutectic aluminum/silicon alloy and a method of producing such a cylinder liner, in which the surface of the cylinder is first roughly machined, then fine machined by boring or turning, and subsequently honed in at least one stage. As a result, the surface particles which are harder than the base microstructure of the alloy, such as silicon crystals and/or intermetallic phases, are exposed in level areas projecting above the remaining surface of the base microstructure of the alloy.

The specific alloy composition of the material used for the cylinder liner allows silicon primary crystals and intermetallic phases to be formed directly from the melt, therefore, there is no need to separately mix-in hard particles. Furthermore, spray compaction of the alloy, a known process which can be readily mastered and is comparatively inexpensive, is used together with subsequent, energy-saving cold extrusion of the blank. This method results in particularly low oxidation of the droplet surfaces and particularly low porosity of the liner. The alloy compositions A and B mentioned below are for use respectively with iron-coated pistons and with uncoated aluminum pistons.

The hard particles formed from the melt have a high hardness and give the surface good wear resistance without seriously impeding the machining of the material, so that the surface is sufficiently readily machinable. Furthermore, because of the formation of the primary crystals and intermetallic phases in each melt droplet sprayed onto and subsequently solidifying on the blank, the process results in a very uniform distribution of hard particles on the workpiece. The particles formed from the melt are also less angular and tribologically less aggressive than crushed particles. Moreover, hard metallic particles formed from the melt are more intimately embedded in the basic alloy microstructure than are nonmetallic crushed particles which have been mixed in. This factor lowers the danger of crack formation at the boundaries of the hard particles. In addition, the hard particles formed from the melt display better breaking-in behavior and lower abrasive aggressivity towards the piston and its rings, so that longer lifetimes result or, in any case, so that less complex piston designs are possible.

Other objects, advantages and novel features of the present invention will become apparent from the following detailed description of the invention when considered in conjunction with the accompanying drawings.

DETAILED DESCRIPTION OF THE INVENTION

Figure 1:
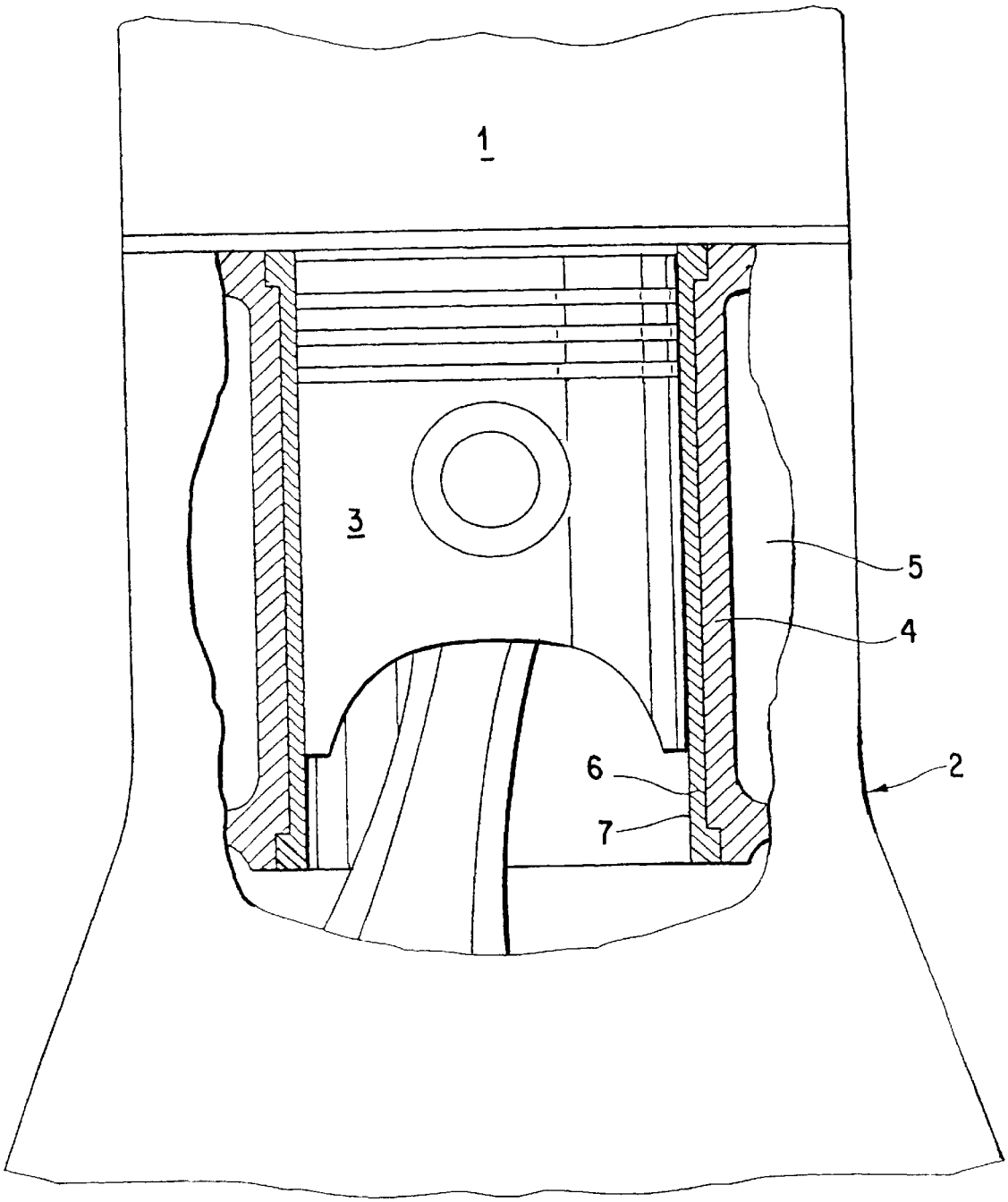
FIG. 1 shows a partial sectional view of a reciprocating piston engine having a sealed-in cylinder liner.

The reciprocating piston engine shown in FIG. 1 comprises a die cast crankcase 2 in which the cylinder wall 4 is arranged to accommodate a cylinder liner 6 in which a piston 3 is installed so as to be able to move up and down. A cylinder head 1, which is attached on top of the crankcase 2, is fitted with devices for charge change and charge ignition. Within the crankcase 2, a hollow space for forming a water jacket 5 around the cylinder wall 4 is provided for cylinder cooling.

The cylinder liner 6 is made as a separate part by the method described in detail below, of a supereutectic composition further described below, and is then sealed as a blank part into the crankcase 2 and machined together with the crankcase. For this purpose, inter alia, the face of the cylinder liner 7 is first roughly premachined and subsequently fine machined by boring or turning. The face 7 is subsequently honed in at least one stage. After honing, the particles lying on the surface which are harder than the base microstructure of the alloy, such as silicon crystals and intermetallic phases, are exposed in such a way that level areas of the particles project above the remaining surface of the base microstructure of the alloy.

The present invention claims a cylinder liner which is improved with respect to increasing wear resistance and decreasing the consumption of lubricating oil, and thereby decreasing the emission of hydrocarbons by an internal combustion engine, and a method of making the cylinder liner.

First, it should be mentioned that two alternative types of preferred alloys have been found, with one alloy, type A, recommended for use together with iron-coated pistons and the other alloy, type B, recommended for use with uncoated aluminum pistons Alloy A has the following composition, the percentages are by weight:

Silicon from 23.0 to 28.0%, preferably about 25%,

Magnesium from 0.80 to 2.0%, preferably about 1.2%,

Copper from 3.0 to 4.5%, preferably about 3.9%,

Iron max. 0.25%

Manganese, nickel and zinc max. of each 0.01% and the remainder aluminum.

Alloy B, for use with uncoated aluminum pistons, has the same composition as alloy A with respect to the proportions of silicon, magnesium, copper, manganese and zinc, with the content of iron and nickel being somewhat higher, namely:

Iron from 1.0 to 1.4%.

Nickel from 1.0 to 5.0% and the remainder aluminum.

A melt of the aluminum/silicon alloy is finely sprayed in an oxygen-free atmosphere and the atomized melt is deposited to create a growing body, first producing a knob containing fine-grained silicon primary crystals 8 and intermetallic particles 9 and 10, with the intermetallic phases containing magnesium and silicon ($Mg_2Si$) and aluminum and copper ($Al_2Cu$). The atomized melt is very quickly cooled in a jet of nitrogen, with cooling rates in the range of $10^6$ K/sec.

This so-called spray compacting produces a microstructure having a very narrow grain size distribution with a range of about ±5 to 10 $\mu$m from a mean value, with the mean value being adjusted within a relatively wide particle size range, from about 7 to 200 $\mu$m. A very fine grain setting is used, with a particle size of from 2 to 10 $\mu$m, so that a correspondingly fine microstructure having a fine and uniform silicon distribution is formed.

Each powder particle contains all the alloy constituents. The powder particles are sprayed onto a rotating plate on which the knob mentioned above has a diameter of, for example, 300 or 1000 mm, depending on the design of the apparatus. Subsequently, into the knobs have to be extruded on an extruder, according to known methods, to form tubes. It is also possible that the knob is not allowed to grow axially on a rotating plate, but that the atomized melt is allowed to grow radially on a rotating cylinder, so that an essentially tubular preproduct is formed.

Figure 2:
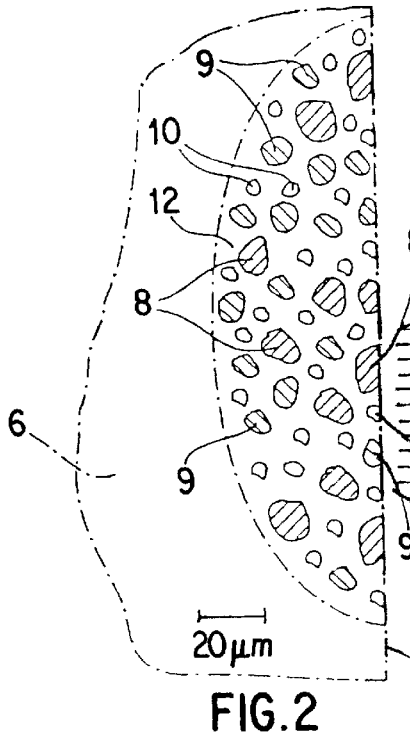
FIG. 2 shows a magnified portion of a cross-section of the cylinder liner close to the surface, taken parallel to the cylinder wall.
Figure 2A:
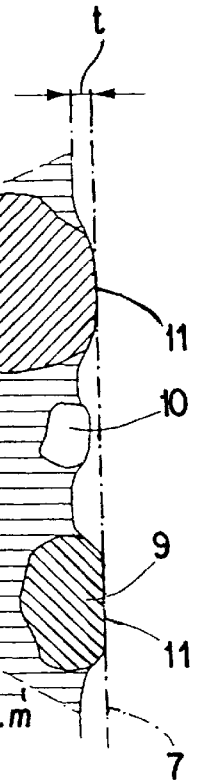
FIG. 2*a* shows a further detailed enlargement of a section of FIG. 2
Figure 3:
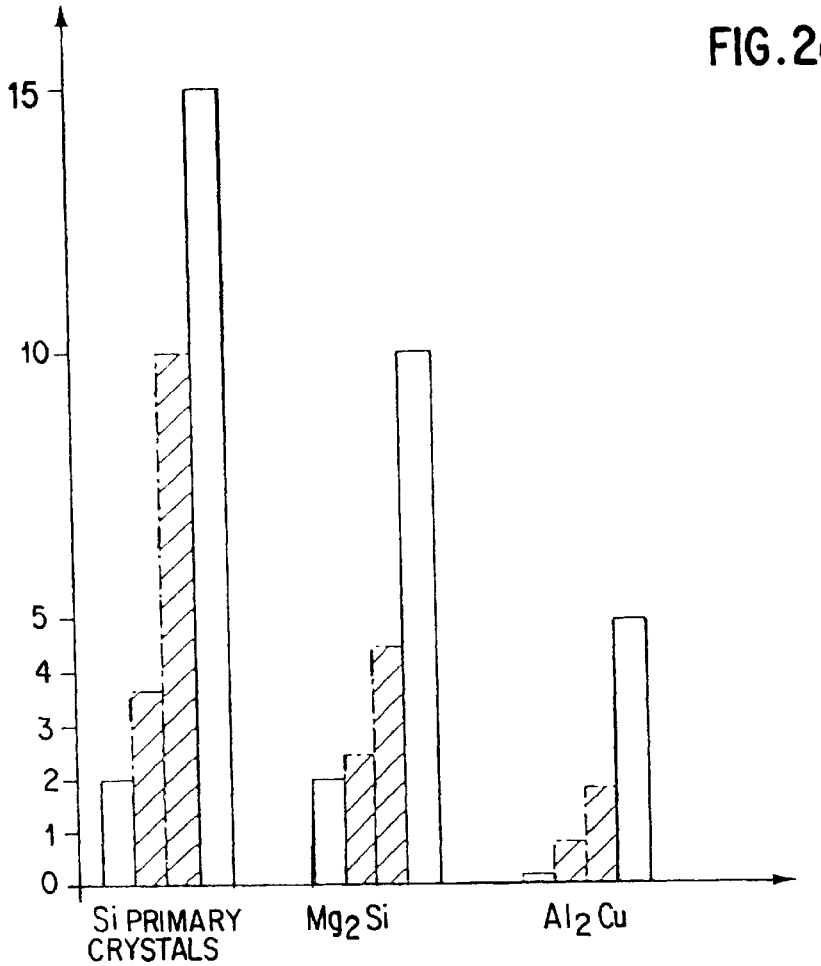
FIG. 3 is a bar graph showing the particle sizes for the various hard particles formed from the melt.

During spraying, the melt is so finely atomized that the silicon primary crystals 8 and the intermetallic particles 9 and 10, seen on FIGS. 2 and 2*a,* which form in the growing knob have very small grain sizes as follows:

Si primary crystals: from 2 to 15 $\mu$m, preferably from 4 to 10 $\mu$m, $Al_2Cu$ phase: from 0.1 to 5.0 μm, preferably from 0.8 to 1.8 μm, $Mg_2Si$ phase: from 2.0 to 10.0 μm, preferably from 2.5 to 4.5 μm.

The fine grained nature of the spray creates a finely dispersed distribution of hard particles within the base microstructure of the alloy and a homogeneous material is obtained. Since a single melt is atomized, no inhomogeneities due to mixing are formed. Additionally, because the atomized melt droplets are compacted, a very intimate bonding between the droplets results, which in turn results in a substantially low porosity.

The blanks of the cylinder liner produced by this process, with possible further machining, are sealed into a crankcase comprising a readily castable aluminum alloy, preferably produced using a pressure die casting process. For this purpose, the prefabricated cylinder liners are pushed onto a guide pin with the die casting mold open. The mold is then closed and the die casting material is injected. According to this method, there is no danger of the cylinder liner material being thermally affected in an uncontrolled way by the die cast melt because of the rapid cooling time and the ability to cool the cylinder liner via the guide pin. Furthermore, the alloy used for die casting is subeutectic and therefore readily processable by casting. Moreover, the thermal expansion of the die cast alloy and the cylinder liner is approximately equal, so that no uncontrolled thermal stresses occurs between the two.

After sealing the cylinder liner into the crankcase, the cylinder is machined on the appropriate surfaces, particularly on the face 7 of the cylinder liner 6. This machining process, for example boring and honing as mentioned here, are known processes. Subsequently, the silicon primary crystals 8 and the particles of intermetallic particles 9 and 10 embedded on the surface have to be exposed.

This exposure is usually carried out chemically by etching, which is not only a time-consuming process, but also pollutes the workplace environment with evaporated etching liquid. In addition, a certain inhomogeneity is unavoidable in etching, because the etching conditions are not completely uniform on the surface to be etched. Therefore, a certain minimum exposure depth must be obtained in order to ensure minimum exposure at even the most unfavorable places. The time spent etching, the safety precautions taken in the workplace, and the ongoing cost of operation, primarily for chemicals, and waste water disposal, make the cost of etching per cylinder liner quite high.

Figure 4:
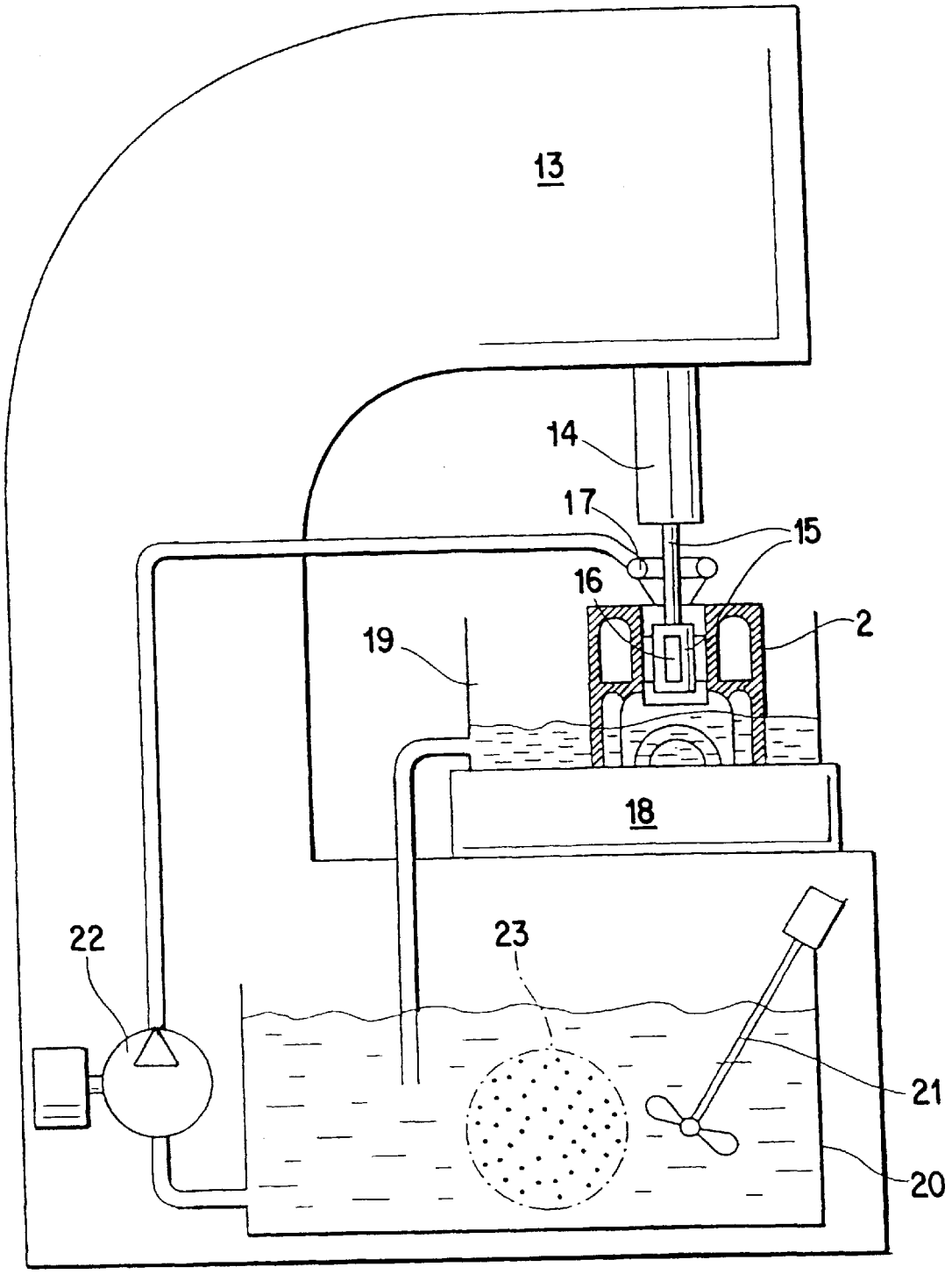
FIG. 4 shows a modified honing machine for mechanically exposing the hard particles from the surface of the cylinder liner.

The present invention uses a different process: the primary crystals 8 and intermetallic particles 9 and 10 embedded in the surface are mechanically exposed by a grinding or polishing process using compliant, shaped polishing or grinding bodies 16, FIG. 4. This avoids not only the disadvantages and costs of etching, but also gives particular advantages for the face 7 of the cylinder liner, as detailed below. The cost per cylinder liner incurred by the mechanical exposure of the present invention are lower than the costs of a honing process.

FIG. 4 represents a honing machine usable in connection with the mechanical exposure described above. The honing machine 13 has a movable machine table 18 on which the crankcase 2 is arranged in a pan 19. Above the machine table 18 at least one vertical honing spindle 14 is arranged into which a honing tool 15 is fitted, which can be lowered into a cylinder bore of the crankcase.

One advantage of the present honing machine is that the honing tool 15 is fitted, not with hard honing stones, but with a plurality of axially orientated felt strips 16 fitted on its circumference which, because felt is soft and compliant, automatically give a cylindrical fit to the inner surface of the cylinder liner. These match the shape of the cylinder and serve as polishing or grinding bodies.

The construction of the honing tool includes metal abrasive carriers which are fitted in the honing tool so as to be radially movable and which can be pressed with adjustable force against the inner surface of the cylinder liner. The metal abrasive carriers are planar, i.e. not cylindrical, on the side facing radially outwards. Flat pieces of a felt mat having a thickness of 9 mm are cut to match the flat surfaces of the metal abrasive carriers and glued onto these flat surfaces. The required cylindrical shape of the felt results automatically when the honing polishing or grinding under pressure of the felt pieces against the inner surface of the cylinder liner is started. The felt material used is a felt designated as Stückfilz Tm 30-9, DIN 61206. The felt designated as St ückfilz Tm 32-9, 61206 would certainly also be suitable. The individual designations used to describe the felt have the following meanings:

m→mixed,

30→bulk density of 0.30 g/cm$^3$

32→bulk density of 0.32 g/cm$^3$,

9=9 mm in thickness.

The hardness of the felt pieces was M6 (or medium 6) in accordance with DIN 61200. In the case of Stückfilz Tm 32 5-9 DIN 61206, a hardness of F1 (or firm 1) according to DIN 61200 could be recommended.

Since the mechanical exposure according to the present invention is carried out in the presence of an abrasive, amorphous grinding or polishing medium containing particles of hard material, the honing machine 13 has a reservoir 20 for holding a slurry 23 of fine particles of hard material, preferably silicon carbide particles in honing oil, placed in proximity of the honing machine to supply the grinding medium. To avoid sedimentation of the particles of hard material, the reservoir is provided with a stirrer 21. A circulation pump 22 conveys the slurry from the reservoir 20 to an annular sprinkling head 17 which goes around the honing tool above the cylinder liner and supplies plenty of grinding fluid.

During mechanical exposure, the rotating honing tool oscillates axially up and down so that all parts of the face 7 of the cylinder liner are in contact with the felt strips 16. Furthermore, the honing tool is configured in such a way that the felt strips can be pressed with an adjustable pressure against the face 7, wherein the pressure is from about 3 to 5 bar, preferably about 4 bar. By using this machining method, the material of the base alloy which is located between the individual harder particles at the surface, is removed to some extent, so that the harder particles project above the abraded base material 12 creating a plateau area 11. The measurement t represents the exposure depth.

According to this method, the edges of the plateau areas 11 are rounded so that they form a smooth contact with the base alloy material 12. This particular configuration of the plateau areas 11 has advantageous for the piston or the piston rings that slide over them, because this configuration is not very aggressive tribologically in comparison to the sharp-edged particles of hard material resulting when chemical exposure is used.

The measure of the exposure depth t can, apart from the force pressing the felt strips, be determined primarily by the duration of the mechanical exposure by the honing process. This is due to the fact that, with an increasing time of exposure, the plateau areas 11 are increasingly rounded and abraded into a dome-like shape. It is therefore advantageous to carry out the mechanical exposure process according to the present invention for from about 20 to 60 seconds, preferably about 40 seconds. This will result in an exposure depth of from about 0.2 to 0.3 μm.

This exposure depth results in a surface roughness which is at least of the same order of magnitude, if not greater, than the exposure depth. The roughness of the surface is essentially determined by the grain size of the particles of hard material in the slurry 23. The roughness values for machined cylinder surfaces are in the range of from 0.7 to 1.0 μm. These roughness values and the low exposure depth permit very low oil consumption and thus a very low emission of hydrocarbons is achieved. In addition, the wear resistance and the sliding properties of the cylinder liners produced by this method are excellent.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of producing a cylinder liner, to be sealed into a reciprocating piston engine comprising a supereutectic aluminum/silicon alloy, wherein:

the aluminum/silicon alloy, which is free of mixed-in independent particles of hard material, is selected from the group consisting of alloy A and alloy B, wherein the alloys have the following composition, in % by weight:

Alloy A:

Silicon from 23.0 to 28.0%,

Magnesium from 0.80 to 2.0%,

Copper from 3.0 to 4.5%,

Iron maximum of 0.25%,

Manganese, nickel and zinc maximum of each 0.01%, and the remainder is aluminum; and Alloy B:

Silicon from 23.0 to 28.0%,

Magnesium from 0.80 to 2.0%,

Copper from 3.0 to 4.5%,

Iron from 1.0 to 1.4%,

Nickel from 1.0 to 5.0%.

Manganese and zinc maximum of each 0.01%, and the remainder is aluminum;

silicon primary crystals and intermetallic particles present in the aluminum/silicon alloy of the cylinder liner have a mean grain diameter as follows, in μm:

Si primary crystals: from 2 to 15 μm, $Al_2Cu$ phase: from 0.1 to 5.0 μm, and $Mg_2Si$ phases: from 2.0 to 10.0 μm;

the silicon primary crystals and the intermetallic particles embedded in the face of the cylinder liner are exposed by fine-machining, wherein plateau areas of the exposed silicon primary crystals and intermetallic particles have rounded edges with respect to the surface of the base aluminum/silicon alloy, said method comprising the steps:

fine spraying a melt of the aluminum/silicon alloy and depositing a mist of the melt to create a growing body, thereby producing a knob containing fine-grained silicon primary crystals and intermetallic particles, wherein during spraying, the melt is so finely atomized that the silicon primary crystals and intermetallic particles which form in the growing knob are obtained having a mean grain diameter, in μm:

Si primary crystals: from 2 to 15 μm, $Al_2Cu$ phase: from 0.1 to 5.0 μm, and $Mg_2Si$ phase: from 2.0 to 10.0 μm,;

forming a tubular semi-finished part by extrusion of the knob from which the cylinder liner is produced as a tubular blank;

sealing the cylinder liner into a supporting crankcase of a reciprocating piston engine;

roughly premachining the face of the sealed-in cylinder liner;

fine machining by boring or turning;

honing in at least one stage;

mechanically exposing the particles lying in the surface which are harder than the base microstructure of the alloy, such as silicon crystals and intermetallic particles, to expose plateau areas of the particles projecting above the surface of the base microstructure of the alloy, by a grinding or polishing process using at least one compliant shaped polishing or grinding body and an abrasive, amorphous grinding or polishing medium containing particles of hard material whose particle size is less than or at most the same as the desired roughness.

2. A method as claimed in claim 1, wherein the mean grain diameter is, in μm:

Si primary crystals: from 4.0 to 10.0 μm, $Al_2Cu$ phase: from 0.8 to 1.8 μm, and $Mg_2Si$ phase: from 2.5 to 4.5 μm.

3. A method as claimed in claim 1, wherein the mechanical exposure of the primary crystals and intermetallic particles is carried out by a honing process using felt strips having an outer cylindrical shape and a slurry of particles of hard material.

4. A method as claimed in claim 3, wherein the slurry of particles of hard material is SiC particles in honing oil.

5. A method as claimed in claim 3, wherein the mechanical exposure of the primary crystals and intermetallic particles is carried out with the felt strips being pressed against a contact point at a pressure of from 3 to 5 bar.

6. A method according to claim 5, wherein the pressure is about 4 bar.

7. A method according to claim 3, wherein the honing process for the mechanical exposure of the primary crystals and intermetallic particles is carried out for from about 20 to 60 seconds.

8. A method according to claim 7, wherein the honing process is carried out for about 40 seconds.

* * * * *